US006155091A

United States Patent [19]

Hayes et al.

[11] Patent Number: 6,155,091

[45] Date of Patent: Dec. 5, 2000

[54] MANDREL ASSEMBLY FOR TUBE-BENDING APPARATUS

[75] Inventors: Jeffrey P. Hayes, Camby; Alford Kessinger, Greenwood, both of Ind.

[73] Assignee: Arvin Industries, Inc., Columbus, Ind.

[21] Appl. No.: 09/259,662

[22] Filed: Feb. 26, 1999

[51] Int. Cl.[7] ..... B21D 9/05

[52] U.S. Cl. ..... 72/150; 403/122

[58] Field of Search ..... 72/466.2, 479, 72/150; 279/74, 57, 82; 403/31, 122, 142, 143, 141

[56] References Cited

U.S. PATENT DOCUMENTS

| | | | |
|---|---|---|---|
| 1,946,629 | 2/1934 | Laughlin . | |
| 1,993,361 | 3/1935 | Cornell, Jr. . | |
| 1,996,838 | 4/1935 | Snell . | |
| 2,018,452 | 10/1935 | Laughlin . | |
| 2,219,008 | 10/1940 | Drissner . | |
| 2,291,397 | 7/1942 | Martin . | |
| 2,291,398 | 7/1942 | Martin . | |
| 2,363,889 | 11/1944 | Martin . | |
| 2,382,060 | 8/1945 | Ingalls . | |
| 2,407,083 | 9/1946 | Koppel . | |
| 2,433,230 | 12/1947 | Martin . | |
| 2,551,077 | 5/1951 | Wilson . | |
| 2,681,808 | 6/1954 | O'Connell . | |
| 2,821,404 | 1/1958 | Sloan . | |
| 2,831,523 | 4/1958 | Wurzburger . | |
| 2,996,100 | 8/1961 | Newhall et al. . | |
| 3,109,477 | 11/1963 | Avera et al. . | |
| 3,117,797 | 1/1964 | Buck . | |
| 3,383,723 | 5/1968 | Connelly . | |
| 3,385,607 | 5/1968 | Hughes . | |
| 3,650,136 | 3/1972 | Sindelar | 72/150 |
| 3,747,394 | 7/1973 | Cunningham . | |
| 3,851,519 | 12/1974 | Calvin et al. . | |
| 3,949,582 | 4/1976 | Eaton et al. | 72/150 |
| 3,964,290 | 6/1976 | Auxer . | |
| 3,974,676 | 8/1976 | Eaton . | |
| 4,027,522 | 6/1977 | Clavin . | |
| 4,063,441 | 12/1977 | Eaton . | |
| 4,080,814 | 3/1978 | Eaton . | |
| 4,086,803 | 5/1978 | Wheeler . | |
| 4,088,007 | 5/1978 | Clavin . | |
| 4,130,004 | 12/1978 | Eaton . | |
| 4,178,788 | 12/1979 | Zollweg et al. . | |
| 4,193,607 | 3/1980 | Pearson et al. . | |
| 4,201,073 | 5/1980 | Eaton . | |
| 4,214,766 | 7/1980 | Rall et al. . | |
| 4,232,813 | 11/1980 | Eaton . | |
| 4,251,084 | 2/1981 | Frnaklin . | |
| 4,269,054 | 5/1981 | Eaton . | |
| 4,289,012 | 9/1981 | Nessi . | |
| 4,309,041 | 1/1982 | Peterson et al. . | |
| 4,352,285 | 10/1982 | LaRue et al. . | |
| 4,495,788 | 1/1985 | Traub . | |
| 4,625,531 | 12/1986 | Lafrasse et al. . | |
| 4,635,464 | 1/1987 | McGuire, Sr. et al. . | |
| 4,732,025 | 3/1988 | Marlinga et al. . | |
| 4,744,233 | 5/1988 | Trudell . | |
| 4,750,346 | 6/1988 | Traub . | |
| 4,760,726 | 8/1988 | Traub . | |
| 4,768,269 | 9/1988 | Williams . | |
| 4,867,463 | 9/1989 | Hopf . | |
| 4,870,849 | 10/1989 | Traub . | |
| 4,916,952 | 4/1990 | Thielmann et al. . | |
| 4,959,984 | 10/1990 | Trudell et al. . | |

(List continued on next page.)

*Primary Examiner*—Rodney A. Butler
*Attorney, Agent, or Firm*—Barnes & Thornburg

[57] ABSTRACT

A mandrel assembly is provided for use with a tube bender including a mandrel rod, a mandrel ball, and a coupler. The coupler is configured to couple the mandrel ball to the mandrel rod and includes a link, a first connector member, a second connector member, and a retainer. The link includes a body and a collar. The first and second connector members are positioned to lie over the second end of the body and cooperate to define a groove sized to receive the collar of the link and a socket sized to retain a projection of the mandrel ball. The retainer is positioned to lie over the first and second connector members and the link to secure the first and second connector members to the link.

44 Claims, 10 Drawing Sheets

U.S. PATENT DOCUMENTS

| | | | |
|---|---|---|---|
| 4,989,435 | 2/1991 | Kaneko . | |
| 5,008,555 | 4/1991 | Mundy . | |
| 5,113,683 | 5/1992 | Lafrasse . | |
| 5,149,111 | 9/1992 | Han . | |
| 5,195,343 | 3/1993 | Malarz . | |
| 5,343,725 | 9/1994 | Sabine . | |
| 5,406,821 | 4/1995 | Sabine et al. . | |
| 5,429,375 | 7/1995 | Mueller et al. . | |
| 5,481,891 | 1/1996 | Sabine . | |
| 5,588,505 | 12/1996 | Heath | 72/150 |

10
14
41
34
43
MOVER
11
20
16
12
31
15
13
49
18
19
28
17
29
32
21
30
25
39
27
39

19
12
29
49
28
25
31
93
20
17
38
30
34
21
95
91
97
37
16
32
27
33

MANDREL ASSEMBLY FOR TUBE-BENDING APPARATUS

BACKGROUND AND SUMMARY OF THE INVENTION

This claims priority under 35 U.S.C. §119(e) to U.S. Provisional Application Ser. No. 60/076,252, filed Feb. 27, 1998, which is expressly incorporated by reference herein.

The present invention relates to an apparatus for bending tubes, and particularly to a mandrel assembly for an apparatus for bending tubes. More particularly, the present invention relates to a mandrel assembly that is positioned to lie in a tube being bent during the bending process.

Tube benders are used to form bends in tubes at predetermined bend locations. Tube benders include a round bend die around which a tube is bent at the predetermined bend locations. During bending, the tube has a tendency to "flatten out" so that the bent portions of the tube no longer have a cylindrical shape.

To prevent the tube from flattening out, a mandrel ball is positioned within the tube at the predetermined bend location where the tube is to be bent. The mandrel ball is coupled to a mandrel rod that positions the mandrel ball at the predetermined bend location. During bending, the mandrel ball supports the predetermined bend location of the tube being bent to maintain the tube's cylindrical shape. The tube is then advanced so that the next predetermined bend location is positioned adjacent the round bend die with the mandrel ball positioned at the new predetermined bend location.

According to the present invention, a mandrel assembly for a tube bender is provided including a mandrel rod, a mandrel ball, and a coupler configured to couple the mandrel ball to the mandrel rod. The mandrel rod is adapted to be coupled to the tube bender. The mandrel ball has a body and a projection coupled to the body. The coupler includes a link, a first connector member, a second connector member, and a retainer. The link includes body and a collar. The body includes a first end coupled to the mandrel rod and a second end spaced apart from the first end. The collar is coupled to the second end of the body. The first and second connector members are positioned to lie over the second end of the body and cooperate to define a groove sized to receive the collar of the link and a socket sized to retain the projection of the mandrel ball. The retainer is positioned to lie over the first and second connector members and the link to secure the first and second connector members to the link.

In a preferred embodiments, the retainer is moveable relative to the link. The retainer engages the first and second connector members to restrain movement of the connector members relative to the link. The mandrel rod includes a lubricant passage; the link includes a lubricant channel in communication with the lubricant passage of the mandrel rod; and the retainer includes a lubricant channel configured to communicate with the lubricant channel of the link. The link includes an outer surface having a diameter less than a diameter of an inner surface of a tube gripper that grips an inner surface of the tube being bent.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
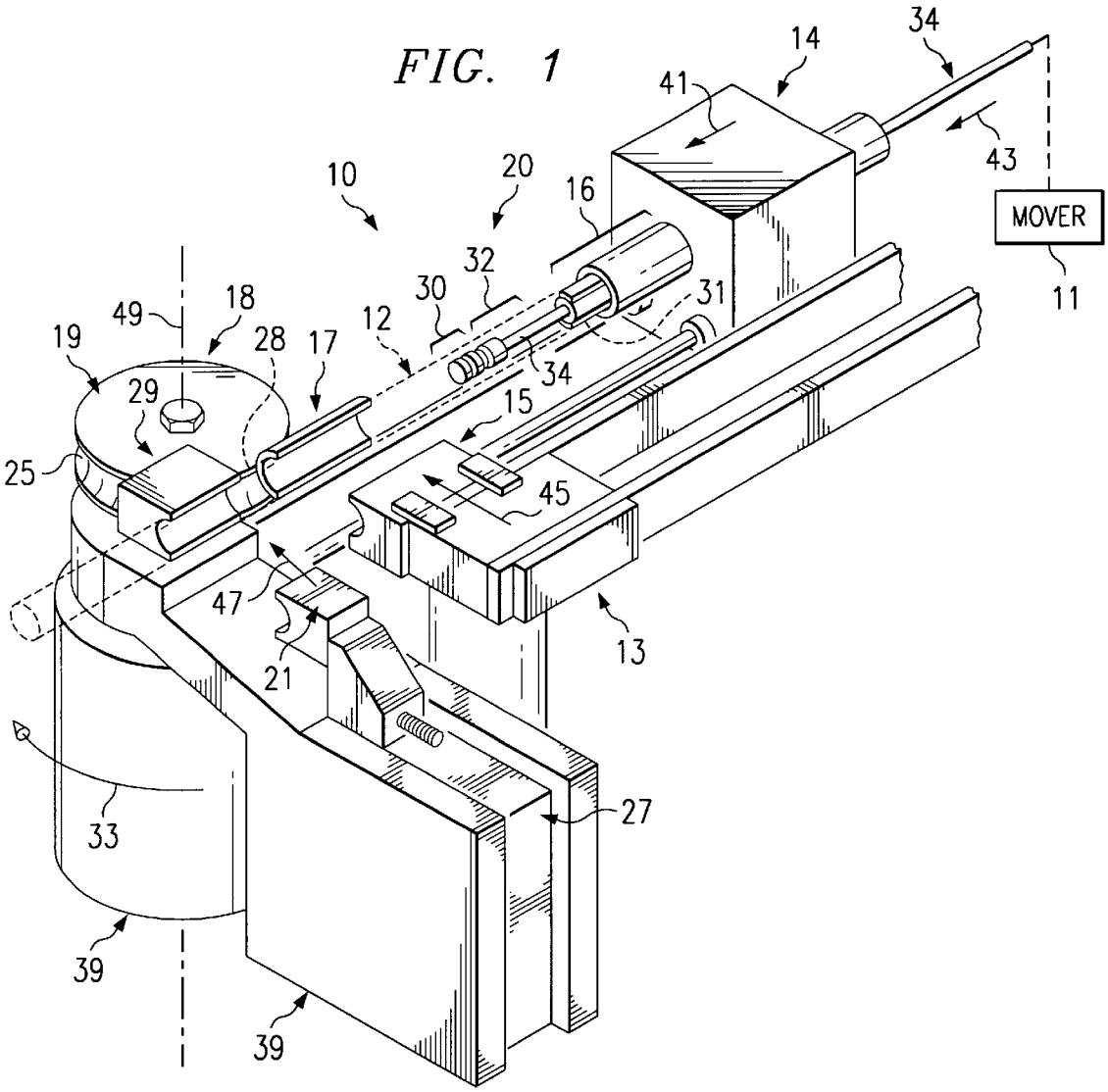
FIG. 1 is a perspective view of a tube bender used in the manufacture of vehicle muffler pipes showing the tube bender and a straight tube (in phantom) mounted in the tube bender, the tube bender including a tube gripper gripping a right end of the tube, a mandrel assembly extending through the tube gripper and the right end of the tube, a round die positioned to lie next to a left end of the tube, a mandrel assembly-mover that moves the mandrel assembly back and forth inside the tube relative to the round die, a tube-mover system that advances the tube relative to the round die, and a tube-forming apparatus that clamps the tube and bends it against and around the round die to bend the tube to assume a predetermined shape.
Figure 2:
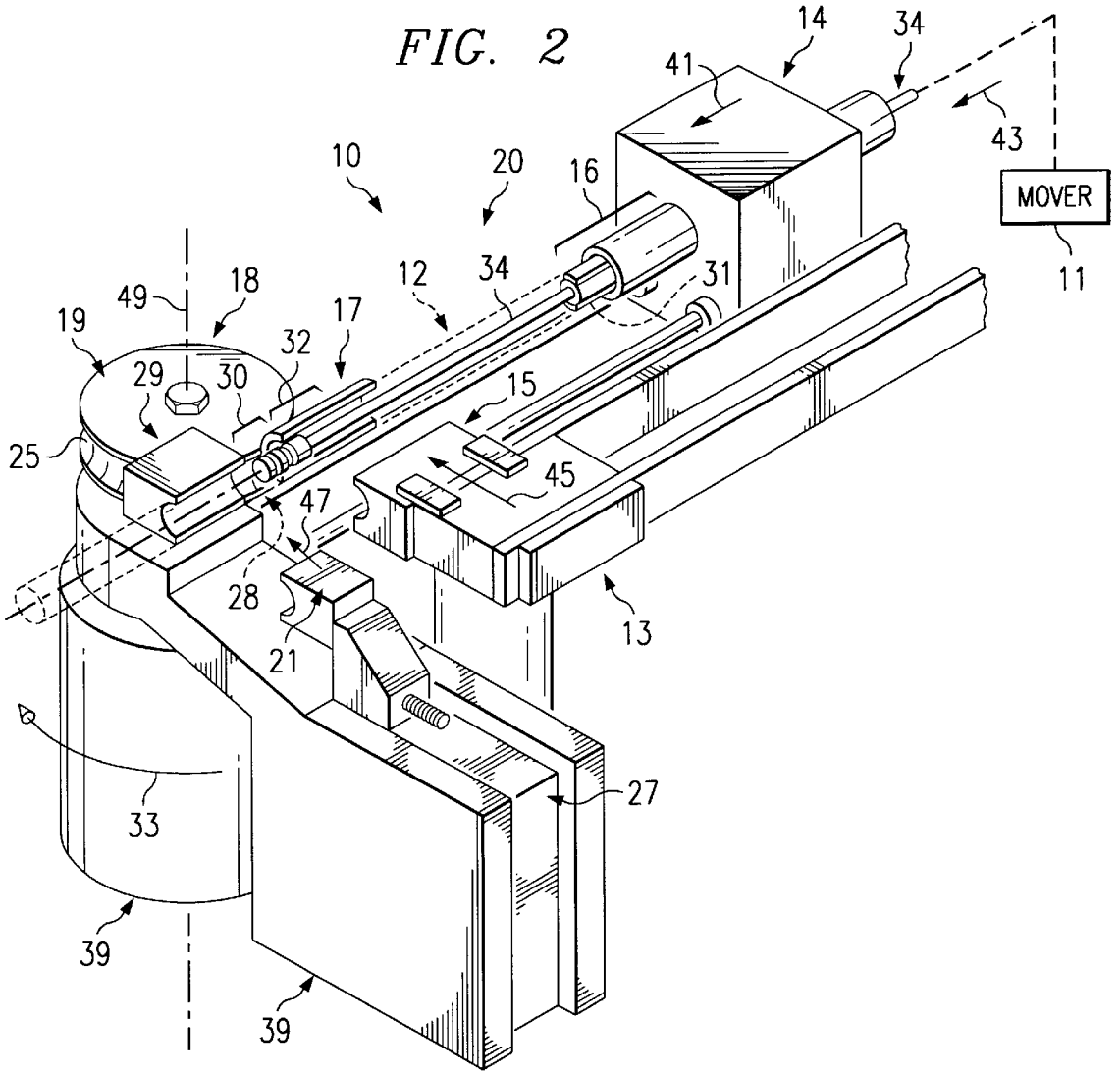
FIG. 2 is a perspective view of the tube bender showing the mandrel assembly advanced toward the round die through the tube, tube gripper, and tube-mover system by the mandrel assembly-mover system.
Figure 3:
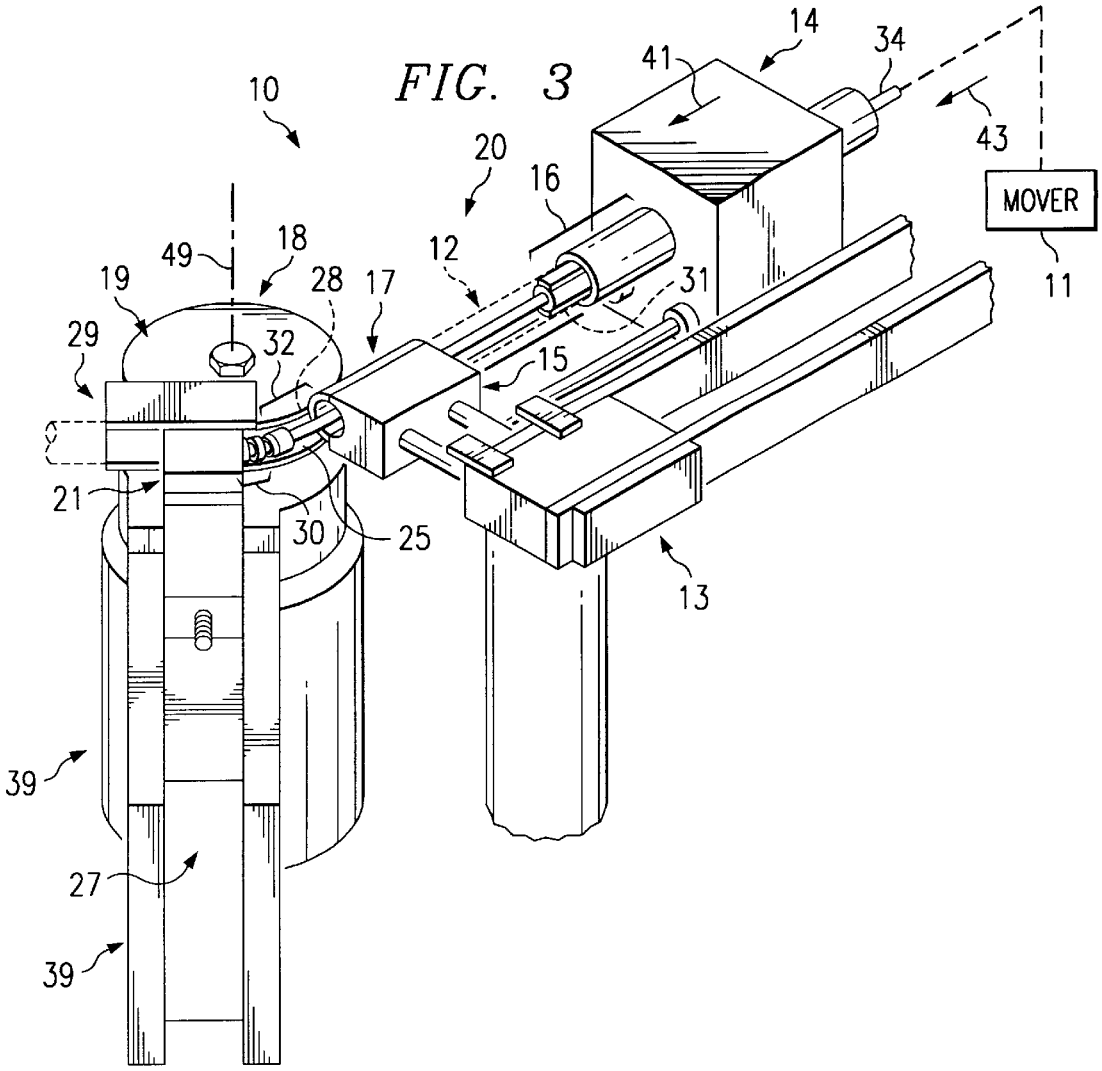
FIG. 3 is a perspective view of the tube bender showing the tube, tube gripper, and tube-mover system advanced toward the round die and the tube clamped and bent by the tube-forming apparatus.
Figure 5:
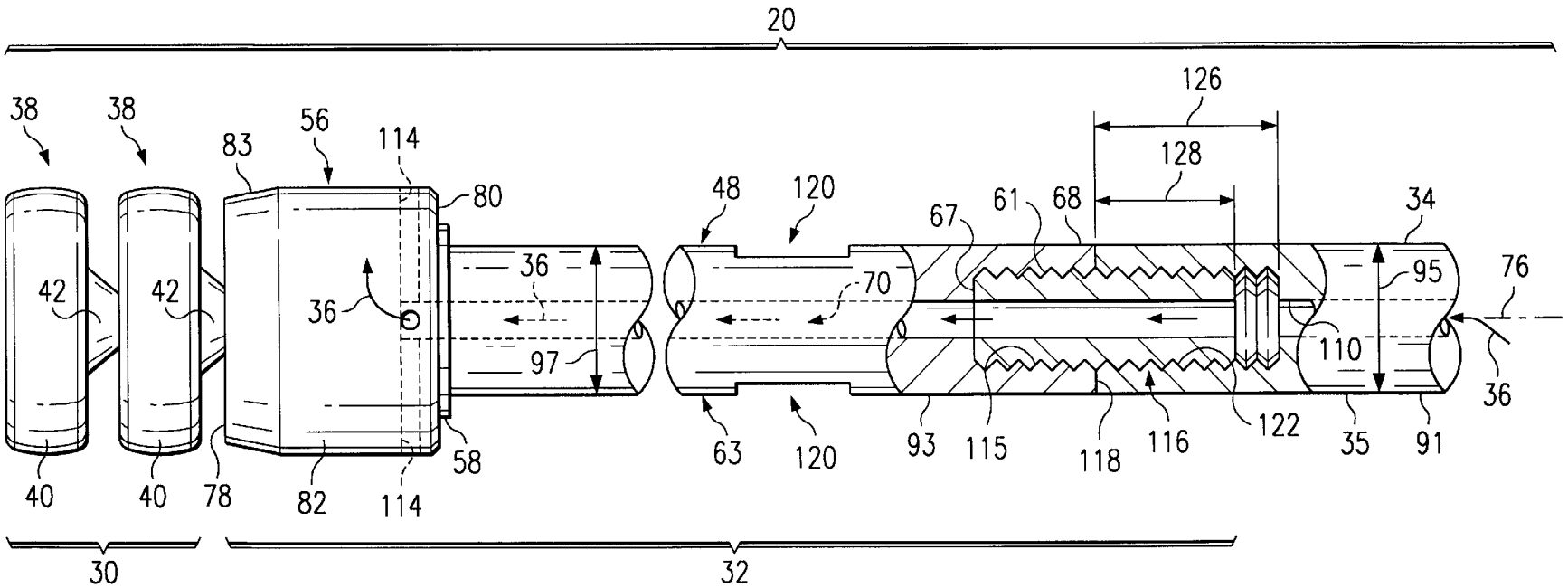
FIG. 5 is a side elevation view of the mandrel assembly, with portions broken away, showing the mandrel assembly including a mandrel ball assembly having two mandrel balls, a coupler having a cylinder-shaped retainer positioned to lie over a portion of one of the mandrel balls and an elongated mandrel rod-connecting link coupled to the retainer and a mandrel rod included in the mandrel assembly.

As shown in FIGS. 1–3, a tube bender 10 bends a tube or work piece 12 using a round die 19, a tube former 18, and a mandrel assembly 20. Mandrel assembly 20 includes a mandrel ball assembly 30, a mandrel rod 34, and a coupler 32 that quickly and accurately couples mandrel ball assembly 30 to mandrel rod 34 as shown in FIG. 5. Tube bender 10 further includes a tube-mover system 14 that advances tube 12 toward round die 19 in direction 41, a tube gripper 16 that mounts tube 12 to tube-mover system 14, and a mandrel assembly-mover system 11 for advancing mandrel assembly 20 toward round die 19 in direction 43. An example of the tube-mover system and the tube gripper are disclosed in U.S. patent application Ser. No. 08/896,030, entitled TUBE BENDER and filed Jul. 17, 1997 by Mark E. Bandy which is incorporated herein by reference.

Round die 19 and tube-forming apparatus 18 shape or form tube 12 into predetermined configurations during a bend cycle. In the bend cycle, tube gripper 16 couples tube 12 to tube-mover system 14 while mandrel ball assembly 30, coupler 32, and mandrel rod 34 are positioned to lie within tube 12. Next, tube-mover system 14 advances tube 12 toward round die 19 and mandrel assembly-mover system 11 advances mandrel assembly 20 toward round die 19 in direction 43 as shown, for example, in FIG. 2.

Tube-forming apparatus 18 then clamps and bends tube 12 to form a predetermined bend 37 in tube 12 around round die 19. As shown in FIG. 3, tube-forming apparatus 18 includes a stationary tube clamp 13, a rotating base 39 that rotates about an axis of rotation 49, and a rotating tube clamp 27 coupled to rotating base 39. Round die 19 is also coupled to rotating base 39 as shown, for example, in FIGS. 1–4. Stationary tube clamp 13 includes a first jaw 15 and a second jaw 17 spaced apart from first jaw 15. Round die 19 includes a forming surface 25 facing away from axis of rotation 49 that is annular and convex. Similar to stationary tube clamp 13, rotating tube clamp 27 includes a first jaw 21 and a second jaw 29 spaced apart from first jaw 29 and coupled to bend die 19.

Figure 4:
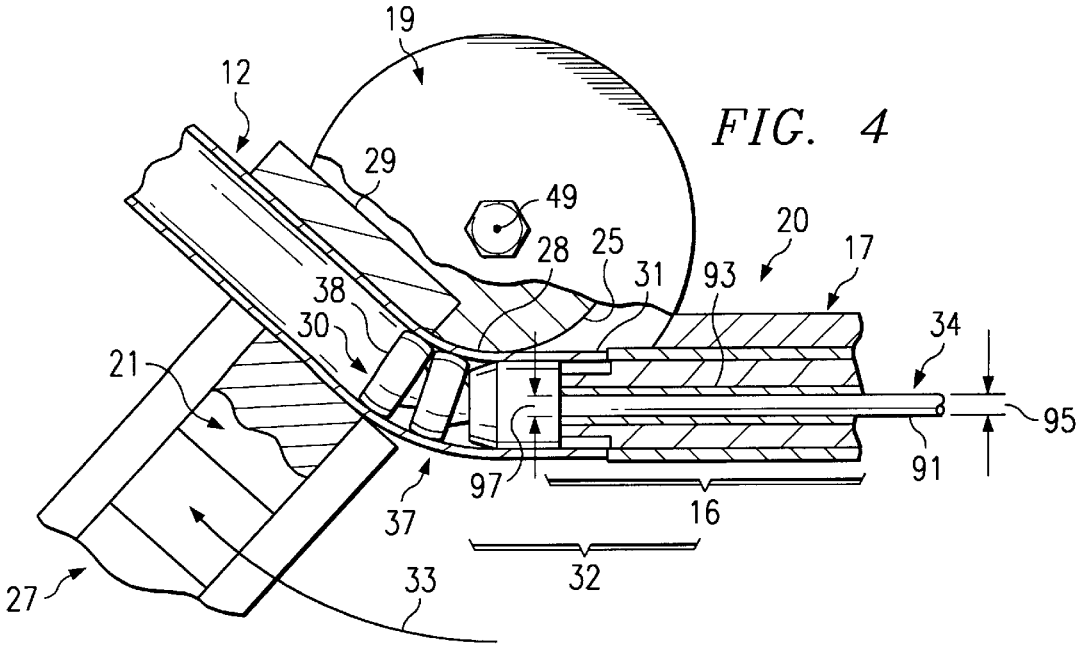
FIG. 4 is a top plan view of the round die and the tube-forming apparatus as shown in FIG. 3, with portions broken away, showing the tube extending over a portion of the mandrel assembly so that a portion of the mandrel assembly is positioned to lie between the round die and the tube-forming apparatus while the tube-forming apparatus forms a bend in the tube.

During a bend cycle, stationary tube clamp 13 moves from an unclamped position, as shown in FIGS. 1 and 2, to a clamped position as shown in FIG. 3. In the clamped position, first jaw 15 of stationary tube clamp 13 is advanced toward second jaw 17 in direction 45 so that first and second jaws 15, 17 clamp tube 12 as shown in FIG. 3. Similarly, during a bend cycle, rotating tube clamp 27 moves from an unclamped position, as shown in FIGS. 1 and 2, to a clamped position as shown in FIGS. 3 and 4. In the clamped position, first jaw 21 of rotating tube clamp 27 is advanced toward second jaw 29 in direction 47 so that first and second jaws 21, 27 clamp tube 12 as shown in FIGS. 3 and 4.

After stationary and rotating tube clamps 13, 27 are in the clamped positions, rotating base 39 of tube-forming apparatus 18, round die 19, and rotating tube clamp 27 of tube-forming apparatus 18 rotate in direction 33 about axis of rotation 49. As these components 39, 19, 27 rotate in direction 33, tube 12 wraps around forming surface 25 of round die 19 and is formed to include bend 37 as shown, for example, in FIGS. 3 and 4. Next, clamps 13, 27 move to the unclamped position and tube 12 is advanced in direction 41 for the next bend cycle.

Figure 9:
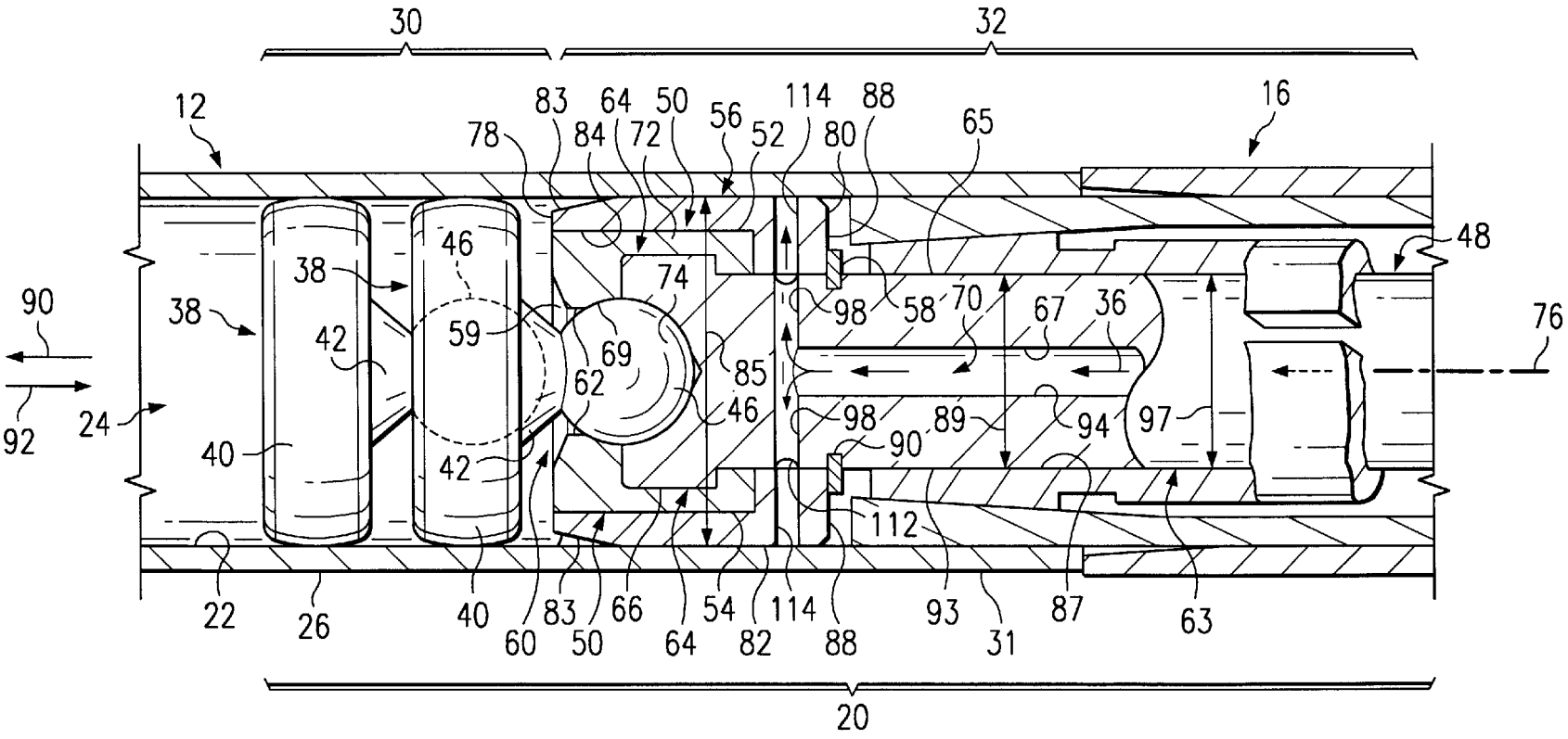
FIG. 9 is a sectional view of the mandrel balls and portions of the coupler and tube gripper positioned to lie within the tube showing the coupler formed to include a lubrication passage that permits a lubricant to pass through the coupler into contact with the mandrel balls.

Tube 12 is shown in FIGS. 4 and 9 and includes an inner surface 22 gripped by tube gripper 16 that defines a tube passageway 24 and an outer surface 26 spaced apart from inner surface 22. Tube 12 also includes predetermined bending portions 28 moved near die assembly 18 for bending and a collet-engaging end 31 as shown, for example, in FIG. 4.

Mandrel assembly 20 substantially fills tube passageway 24 at predetermined bending portions 28 during bending of each respective bending portion 28 to help prevent predetermined bending portions 28 from being "flattened out" by die assembly 18 during a bend cycle. Mandrel assembly 20 includes mandrel ball assembly 30, coupler 32 coupled to mandrel ball assembly 30, and a mandrel rod 34 coupled to coupler 32 and tube-mover system 14 as shown, for example, in FIGS. 1–5. Before the bend cycle, tube-mover system 14 moves mandrel assembly 20 to position mandrel ball assembly 30 between round die 19 and first jaw 21 of rotating tube clamp 27 so that mandrel ball assembly 20 is positioned to lie within predetermined bend position 28 of tube 12 during the bend cycle as shown in FIG. 4. By placing mandrel ball assembly 30 between round die 19 and first jaw 21 of rotating tube clamp 27 during the bend cycle, mandrel ball assembly 30 supports inner surface 22 of the tube 12 at the respective bending portion 28 to prevent tube 12 from being compressed or flattened out at predetermined bending portion 28.

Figure 6:
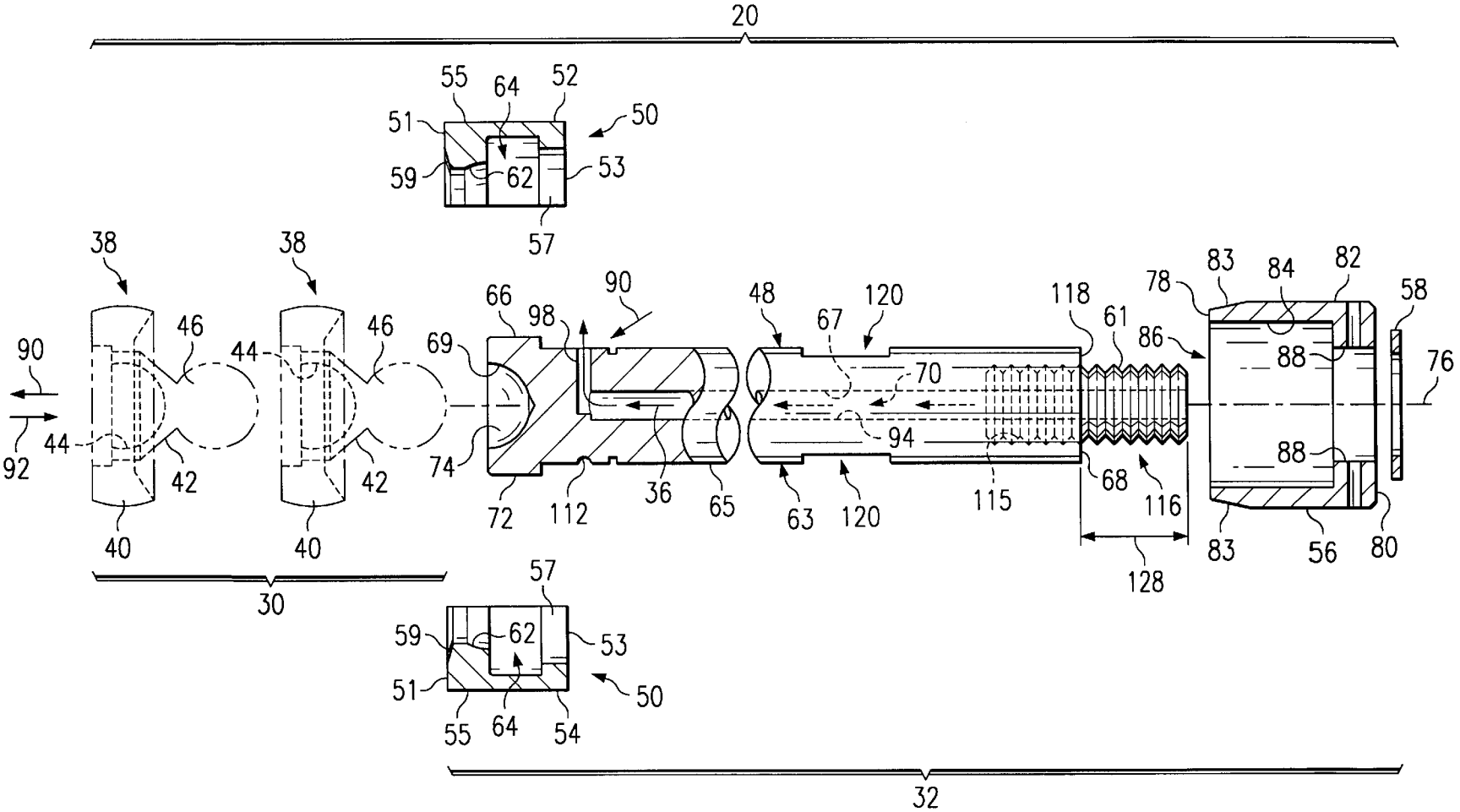
FIG. 6 is an exploded side elevation view of the mandrel assembly, with portions broken away, showing the coupler including a two-piece connector, the retainer, the mandrel rod-connecting link, and a snap ring.
Figure 7:
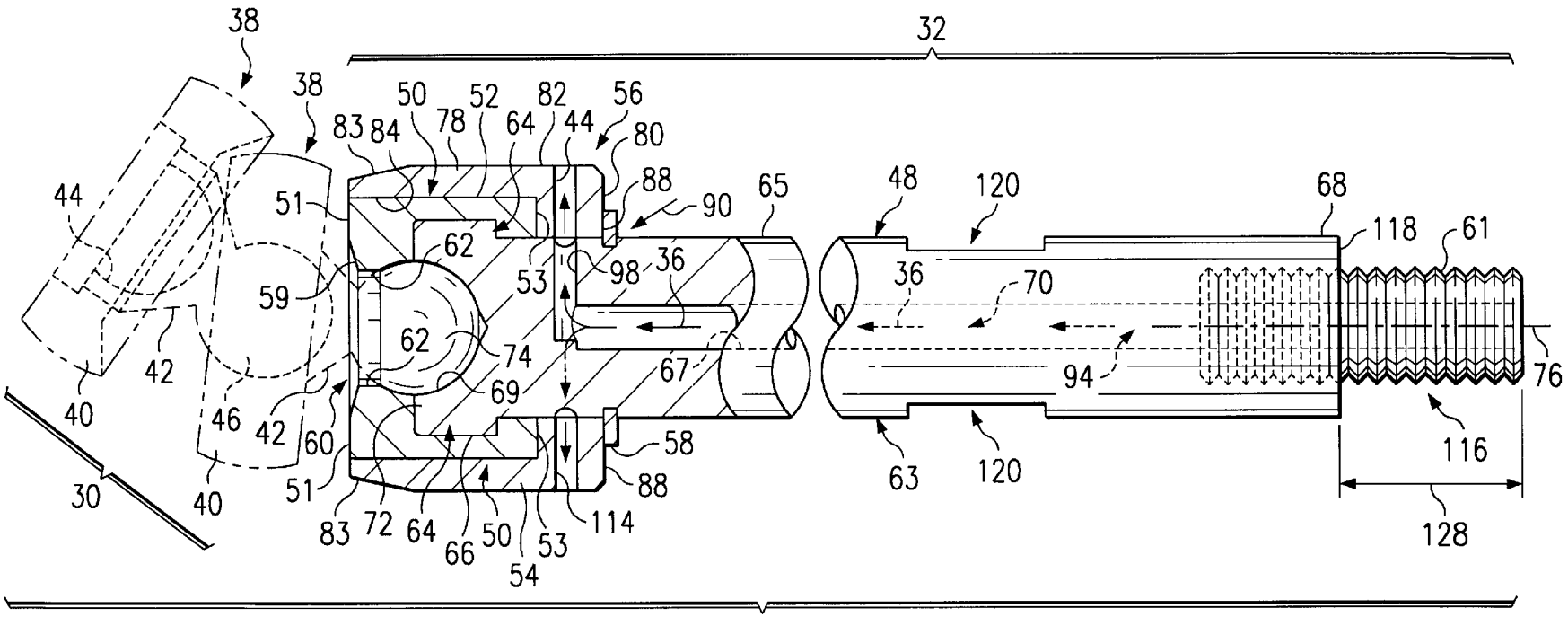
FIG. 7 is a side elevation view of the mandrel assembly, with portions broken away, showing the mandrel balls coupled to the mandrel rod-connecting link by the two-piece connector, retainer, and snap ring.
Figure 8:
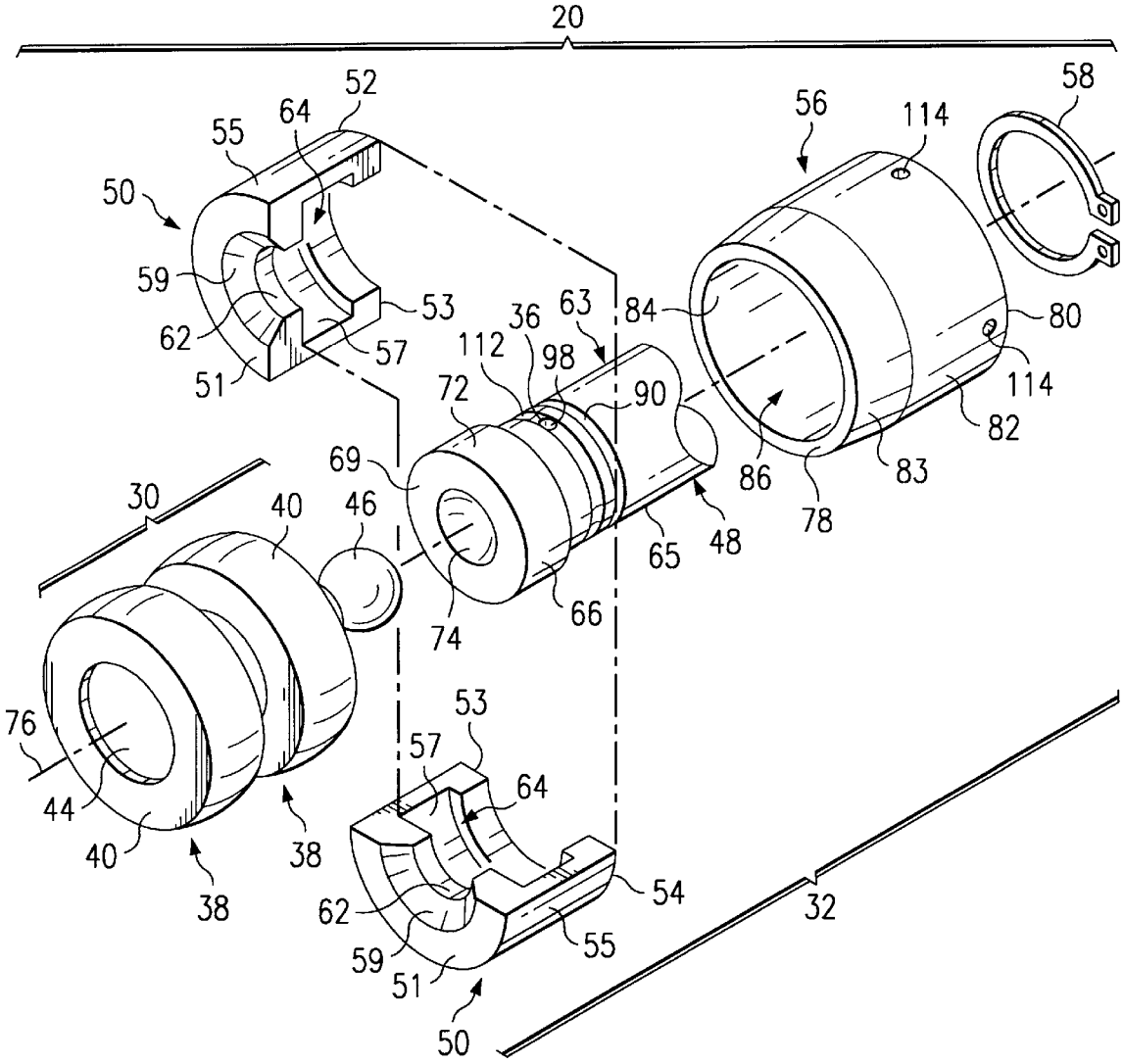
FIG. 8 is a perspective exploded view of several components of the mandrel assembly, with portions broken away, showing the mandrel balls, two-piece connector, mandrel rod-connecting link, retainer, and snap ring.

Mandrel ball assembly 30 includes a plurality of mandrel balls 38 having doughnut-shaped bodies 40 that support inner surface 22 of tube 12 during bending and projections 42 extending from each body 40 as shown in FIGS. 4–9. Each body 40 is formed to include a socket 44 and each projection 42 includes a ball 46 configured to fit within socket 44 of an adjacent body 40 to form a ball-and-socket connection as shown, for example, in FIGS. 6, 7, and 9. The ball-and-socket connection provides universal motion between mandrel balls 38 and permits mandrel ball assembly 30 to conform to tube 12 while it is straight before a bend cycle, as shown in FIG. 9, and while it is bent during and after a bend cycle, as shown in FIGS. 3, 4, and 7. Mandrel balls 38 are well known to those of ordinary skill in the art and are available, for example, from Mckee Machine Tool Corporation of Wilmington, Ohio. As shown in FIGS. 1–9, there are two mandrel balls 38 in mandrel ball assembly 30. In alternative embodiments, fewer or more mandrel balls 38 may be included in mandrel ball assembly 30.

Coupler 32 couples mandrel ball assembly 30 to a first end 35 of mandrel rod 34 and provides a lubrication passage 36 therebetween as shown in FIG. 5. Coupler 32 includes an elongated mandrel rod-connecting link 48, a two-piece connector 50 having first and second connector members 52, 54, a retainer 56, and a snap ring 58. As shown in FIGS. 7 and 9, first and second connector members 52, 54 enclose a portion of link 48 and ball 46 of adjacent mandrel ball 38 to provide universal motion between link 48 and mandrel balls 38. Retainer 56 slides over first and second connector members 52, 54 of two-piece connector 50 to secure first and second connector members 52, 54 axially and radially together over ball 46. Snap ring 58 then couples to link 48 to secure retainer 56 axially on link 48.

First and second connector members 52, 54 of two-piece connector 50 and link 48 cooperate to define a socket 60 for receiving ball 46 of adjacent mandrel ball 38 as shown in FIGS. 7 and 9. First and second connector members 52, 54 are half cylinder-shaped and include a first end 51, a second end 53 spaced apart from first end 51, an outer surface 55 facing substantially away from axis 76, and an inner surface 57 facing substantially toward axis 76. Inner surfaces 57 define first and second radial grooves 62, 64. First radial grooves 62 are spherical to conform to ball 46 as shown, for example, in FIGS. 6–9. Link 48 is rod-shaped and includes body 63 having a first end 66 and a second end 68 spaced apart from first end 66, an outer surface 65 facing substantially away from axis 76, an inner surface 67 facing substantially toward axis 76 and defining a lubrication passage 70 that extends between first and second ends 66, 68, a collar 72 coupled to first end 66 of body 63, and a threaded nipple 61 coupled to second end 68 of body 63. First end 66 of body 63 includes a surface 69 defining a dimple 74 configured to conform to ball 46 as shown, for example, FIGS. 6–9.

First radial grooves 62 of first and second connector members 52, 54 and dimple 74 of link 48 cooperate to form socket 60 when coupler 32 is in an assembled position as shown in FIGS. 7 and 9. Thus, first and second connector members 52, 54 and link 48 aid in capturing ball 46 to couple mandrel balls 38 to link 48 and provide universal motion between link 48 and mandrel balls 38. Inner surfaces 57 of first and second connector members 52, 54 also include tapered portions 59 positioned to lie between first radial groove 62 and first end 51. Tapered portions 59 provide clearance for projection 42 of adjacent mandrel ball 38 during universal motion of mandrel balls 38 relative to mandrel ball-connector assembly 32 as shown in FIGS. 3 and 4.

First and second connector members 52, 54 are coupled to link 48 to prevent relative axial motion therebetween along axis 76 in directions 90 or 92. Collar 72 fits within second radial grooves 64 of first and second connector members 52, 54 when coupler 32 is in the assembled position as shown in FIGS. 7 and 9. Because collar 72 fits within grooves 64, first and second connector members 52, 54 and link 48 are mechanically locked to prevent relative motion therebetween along axis 76 in directions 90, 92.

Retainer 56 secures first and second connector members 52, 54 radially relative to link 48. In preferred embodiments, retainer 56 is a cylinder-shaped sleeve and includes a first end 78, a second end 80 spaced apart from first end 78, an outer surface 82 facing substantially away from axis 76, and an inner surface 84 facing substantially toward axis 76. Inner surface 84 defines a passage 86 extending between first and second ends 78, 80 as shown in FIGS. 6–9. Outer surface 82 has an outer diameter 85 less than the inner diameter of tube 12 to permit retainer 56 to slide within tube 12 as shown in FIG. 9. Outer surface 82 includes a tapered portion 83 that aids in inserting retainer 56 into and through tube 12 as shown in FIG. 9.

Inner surface 84 of retainer 56 defines a flange 88 positioned to lie at second end 80 and extend into passage 86 toward axis 76 as shown in FIGS. 7 and 9. As shown in FIGS. 7 and 9, two-piece connector 50 is positioned to lie in passage 86 in the assembled position. Flange 88 of retainer 56 abuts second ends 53 of first and second connector members 52, 54 of two-piece connector 50 as shown in FIGS. 7 and 9. Thus, after retainer 56 is slid from a first position spaced apart from first and second connector members 52, 54 to a second position over first and second connector members 52, 54, first and second connector members 52, 54 are prevented from moving radially away from axis 76 in relation to link 48.

As previously mentioned, collar 72 of link 48 prevents motion between first and second connector members 52, 54 and link 48 along axis 76. Likewise, the contact between second end 53 of first and second connector members 52, 54 and flange 88 of retainer 56 prevents axial motion between link 48 and retainer 56 in direction 90.

Retainer 56 is secured to link 48 along axis 76 in direction 92 by snap ring 58. Link 48 is formed to include a snap-ring groove 90 as shown, for example, in FIGS. 6–9. After retainer 56 is slid from the first position to the second position so that retainer 56 abuts first and second connector members 52, 54, snap ring 58 is positioned to lie in snap-ring groove 90 using snap-ring pliers (not shown) so that snap ring 58 abuts second end 80 of retainer 56 to restrict motion between link 48 and retainer 56 in direction 92. Thus, while snap ring 58 is positioned to lie in snap-ring groove 90, it acts as a fastener coupling retainer 56 in a fixed position relative to link 48 along axis 76 in directions 90, 92 so that first and second connector members 52, 54 of two-piece connector 50 couple mandrel balls 38 to link 48. This coupling of first and second connector members 52, 54, retainer 56, and snap ring 58 does not hinder the universal motion of mandrel balls 38 relative to link 48. Snap ring 58 is removed from snap-ring groove 90 with snap-ring pliers to disassemble mandrel assembly 20 in the reverse order of assembly.

Because mandrel assembly 20 moves through tube 12 and mandrel balls 38 move in universal motion relative to each other and link 48, lubrication is required to limit frictional forces and wear between mandrel assembly 20 and tube 12. Lubrication passage 36 of coupler 32 provides a means for supplying a lubricant (not shown) to mandrel assembly 20 to reduce this friction.

Link 48 and retainer 56 cooperate to define lubrication passage 36 that delivers lubricant from mandrel rod 34 to coupler 32 and mandrel balls 38. Lubrication passage 70 of link 48 includes a main channel 94 defined by body 63 and threaded nipple 61 extending along axis 76 and several side channels 98 extending from main channel 94 to outer surface 65 of link 48 as shown in FIGS. 6 and 9. Main channel 94 is in communication with side channels 98 and a lubrication passage formed in mandrel rod 34 to provide a conduit for lubrication to move between a mandrel rod lubrication passage 110 formed in mandrel rod 34, as shown in FIG. 5, to side channels 98. Side channels 98 is in communication with an annular lubrication groove 112 defined by outer surface 65 of link 48 to permit movement of lubrication to groove 112.

Retainer 56 is formed to include several side channels 114 extending through flange 88 from inner surface 84 to outer surface 82. Groove 112 is in communication with side channels 114 to provide a conduit for lubrication to move from side channels 98 formed in link 48 to side channels 114 formed in retainer 56. Side channels 114 then provide a conduit for lubrication to move from groove 112 to outer surface 82 of retainer 56 to provide lubrication between tube 12 and mandrel assembly 20. From side channels 114, lubrication works towards mandrel balls 38 by the forward and backward motion of mandrel assembly 20 through tube 12 during the bend cycles.

Mandrel balls 38 and other components of mandrel assembly 20 occasionally need to be replaced due to normal wear and tear of operation. Furthermore, assorted sizes of mandrel assemblies (not shown) other than mandrel assembly 20 are required to bend tubes (not shown) having different diameters than tube 12. Therefore, it is periodically necessary to remove mandrel assembly 20 from mandrel rod 34 to either replace it for wear and tear or for bending a different sized tube.

Each mandrel assembly 20 is removably coupled to mandrel rod 34 in a predetermined position relative to mandrel rod 34 so that calibration is not required upon exchange of mandrel assemblies. When such a change is required, a mandrel assembly 20 is removed from mandrel rod 34 and replaced with another mandrel assembly 20 at the predetermined position in relation to mandrel rod 34 along axis 76. It is necessary to maintain this predetermined position so that mandrel balls 38 are properly positioned in relation to die assembly 16 during the bend cycle.

Each mandrel assembly 20 is coupled to mandrel rod 34 in this predetermined position to facilitate quick change over of mandrel assemblies and substantially accurate positioning of mandrel assembly 20 in relation to mandrel rod 34 along axis 76 so that an additional calibration process to position mandrel assembly 20 is not required. It is necessary to maintain this predetermined position so that mandrel balls 38 are properly positioned relative to die assembly 16 during bending. Second end 68 of body 63 is formed to include female screw threads 115 and a shoulder 118 as shown in FIGS. 5–7. Female screw threads 115 are sized to receive a portion of male screw threads 116 provided on threaded nipple 61 so that a portion of male screw threads 116 are exposed from body 63 to provide a connection portion of link 48. Threaded nipple 61 is coupled to body 63 by Loctite®. According to an alternative embodiment, the exposed male screw threads 116 may also be formed in second end 68 of body 63 by a machining process.

Link 48 is also formed to include a set of wrench flats 120 positioned to lie between first and second ends 66, 68 as shown, for example in FIGS. 5–7. Similar to link 48, first end 35 of mandrel rod 34 is formed to include female screw threads 122 providing a connection portion and a shoulder 124. Female screw threads 122 have a length 126 that is greater than a length 128 of male screw threads 116 as shown in FIG. 5.

A wrench (not shown) is used on wrench flats 120 to turn mandrel assembly 20 onto mandrel rod 34. Because length 128 of male screw threads 116 of link 48 is less than length 126 of female screw threads 122 of mandrel rod 34, shoulder 118 of link 48 abuts shoulder 124 of mandrel rod 34 when mandrel assembly 20 is fully turned onto and coupled to mandrel rod 34. When shoulder 118 of link 48 abuts shoulder 124 of mandrel rod 34, mandrel assembly 20 is substantially in the predetermined position in relation to mandrel rod 34 along axis 76. Therefore, no calibration other than fully turning mandrel assembly 20 onto mandrel rod 34 until shoulders 118, 124 abut is required to determine if mandrel assembly 20 is substantially in the predetermined relation to mandrel rod 34 along axis 76.

As shown in FIG. 9, tube gripper 16 grips inner surface 22 of tube 12. Tube gripper 16 includes an inner surface 87 facing axis 76 and having an inner diameter 89. Mandrel rod 34 and link 48 have outer surfaces 91, 93, having respective outer diameters 95, 97, that are substantially the same as shown in FIGS. 4 and 5. Outer diameters 95 and 97 are less than inner diameter 89 so that mandrel rod 34 and link 48 are positioned within tube gripper 16 and may move and slide within tube gripper 16.

Figure 10:
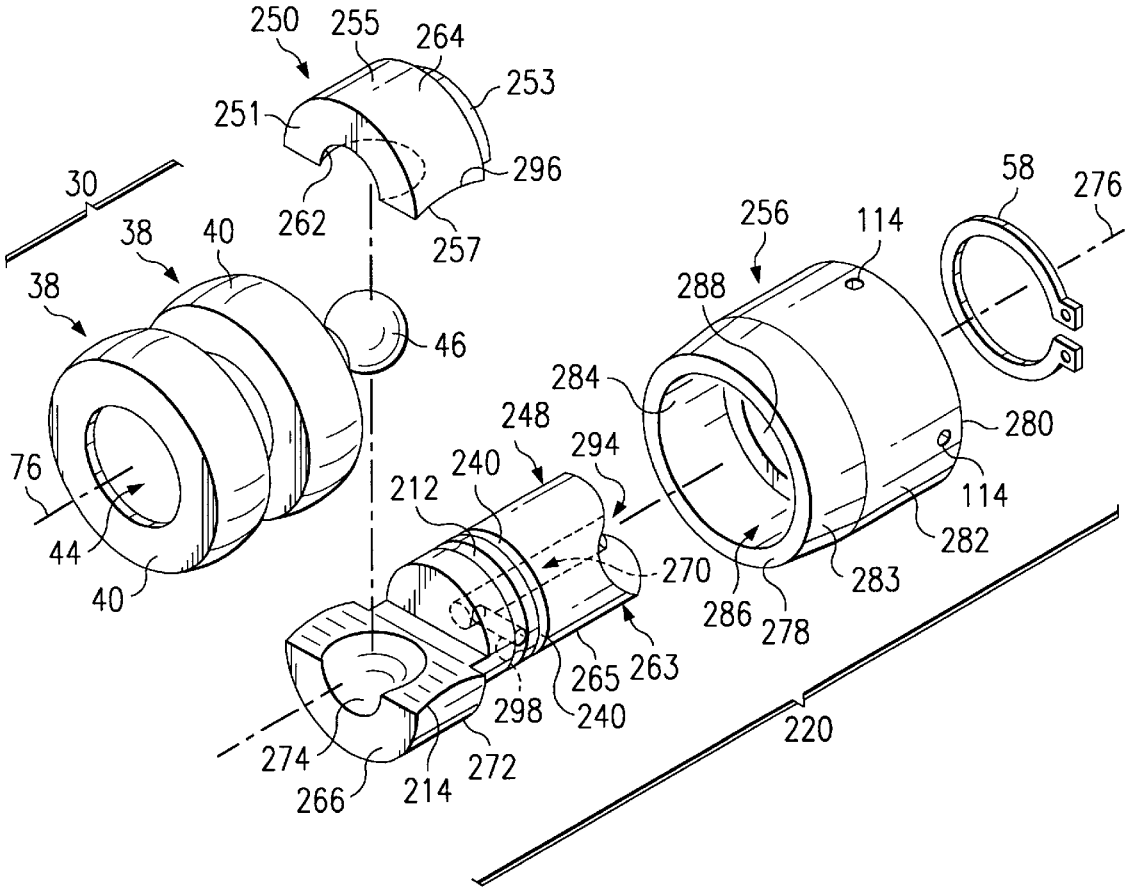
FIG. 10 is a perspective exploded view of another embodiment of a mandrel assembly showing the mandrel assembly including mandrel balls and a coupler.
Figure 11:
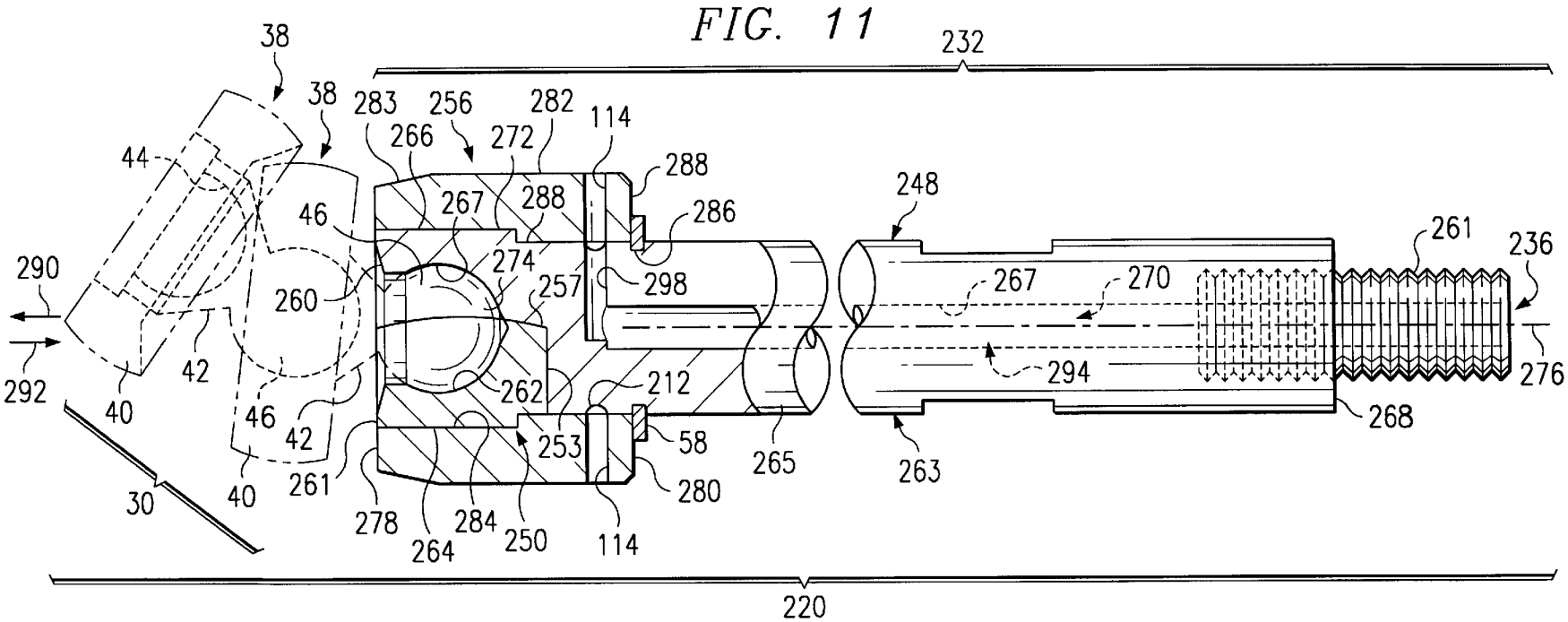
FIG. 11 is a side elevation view, with portions broken away, of the mandrel assembly of FIG. 10 showing the mandrel assembly assembled.
Figure 12:
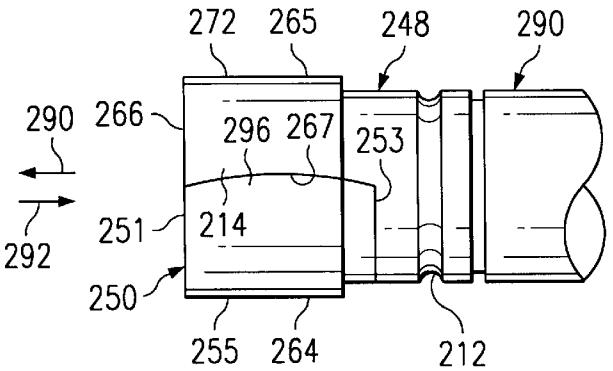
FIG. 12 is a partial side elevation view of the coupler of FIG. 10.

An alternative embodiment of a mandrel assembly 220 in accordance with the present invention is shown in FIGS. 10–12. Mandrel assembly 220 includes a mandrel ball assembly 30, a coupler 232 coupled to mandrel ball assembly 30, and a mandrel rod 34 coupled to coupler 232 and mandrel assembly-mover system 11. Coupler 232 couples mandrel ball assembly 30 to first end 35 of mandrel rod 34 and provides a lubrication passage 236 therebetween.

Coupler 232 includes a mandrel rod-connecting link 248, a one-piece connector 250, a retainer 256, and snap ring 58. As shown in FIG. 11, one-piece connector 250 and link 248 enclose ball 46 of adjacent mandrel ball 38 to provide universal motion between link 248 and mandrel balls 38. Retainer 256 slides over one-piece connector 250 and link 248 to secure one-piece connector 250 over ball 46. Snap ring 58 then couples retainer 256 to link 248.

One-piece connector 250 and link 248 cooperate and form a socket 260 for receiving ball 46 of adjacent mandrel ball 38 as shown in FIG. 11. One-piece connector 250 is half cylinder-shaped and includes a first end 251, a second end 253 spaced apart from first end 251, an outer surface 255 facing substantially away from an axis 276, and an inner surface 257 facing substantially toward axis 276. Outer surface 255 defines a collar 264. Inner surface 257 defines a half-sphere shaped dimple 262 and a concave portion 296. Dimple 262 conforms to ball 46 as shown, for example, in FIGS. 11 and 12.

Link 248 is rod-shaped and has body 263 having a first end 266 and a second end 268 spaced apart from first end 266, an outer surface 265 facing substantially away from axis 276, an inner surface 267 facing substantially toward axis 276 and defining a lubrication passage 270 that extends between first and second ends 266, 268, a collar 272 coupled to first end 266 of body 263, and a threaded nipple 261 coupled to second end 268 of body 263. First end 266 of body 263 is formed to include a half-sphere shaped dimple 274 configured to conform to ball 46 and a convex portion 214 as shown, for example, FIGS. 11 and 12.

Dimple 262 of one-piece connector 250 and dimple 274 of link 248 cooperate to form socket 260 when coupler 232 is in an assembled position as shown in FIG. 11. Thus, one-piece connector 250 and link 248 aid in capturing ball 46 to provide universal motion between link 248 and mandrel balls 238.

One-piece connector 250 is keyed to link 248 to prevent relative axial motion therebetween along axis 276 in directions 290 or 292. Concave portion 214 of link 248 mates with convex portion 296 of one-piece connector 250 as shown in FIG. 10. Because concave portion 214 fits within convex portion 296, one-piece enclosure 250 and link 248 are mechanically locked in relative motion along axis 276 in directions 290, 292 while in the assembled position.

One-piece connector 250 is secured from radial motion relative to link 248 by retainer 256. In preferred embodiments, retainer 256 is a cylinder-shaped sleeve and includes a first end 278, a second end 280 spaced apart from first end 278, an outer surface 282 facing substantially away from axis 276, and an inner surface 284 facing substantially toward axis 276. Inner surface 284 defines a passage 286 extending between first and second ends 278, 280. Outer surface 282 slides within tube 12 and includes a tapered portion 283 that aids in inserting retainer 256 into and through tube 12 as shown in FIG. 11. Retainer 256 further includes a flange 288 positioned at second end 280 and extending into passage 286 toward axis 276 as shown in FIGS. 11 and 12. As shown in FIG. 11, one-piece connector 250 is positioned to lie in passage 286 while in the assembled position. Flange 288 of retainer 256 abuts collar 264 of one-piece connector 250 as shown in FIG. 10. Thus, after retainer 256 is slid over one-piece enclosure 250, one-piece connector 250 is prevented from moving radially away from axis 276 in relation to link 248.

Similar to mandrel assembly 20, retainer 256 is secured in along axis 276. Flange 288 of connector 256 abuts collar 272 of link 248 and prevents relative motion between link 248 and retainer 256 in direction 290 along axis 276.

Similar to mandrel assembly 20, retainer 256 of mandrel assembly 220 is secured to link 248 by placing snap ring 58 into a snap-ring groove 290 formed in link 248 to prevent axial motion between link 248 and retainer 256 in direction 292. Thus, after snap ring 58 is positioned to lie in snap-ring groove 290, mandrel balls 238, one-piece connector 250, and retainer 256 are fixed in relative axial motion along axis 276 in directions 290, 292 in relation to link 248. This coupling of one-piece connector 250, retainer 256, and snap ring 58 does not hinder the universal motion of mandrel balls 38 relative to link 248. Snap ring 58 is removed from snap-ring groove 290 to disassemble mandrel assembly 220 in the reverse order of assembly.

Because mandrel assembly 220 moves through tube 12 and mandrel balls 38 move in universal relative motion to link 248, lubrication is required to limit frictional forces and wear. Lubrication passage 236 provides a means for supplying a lubricant (not shown) to mandrel assembly 220 to reduce this friction.

Link 248 and retainer 256 cooperate to form lubrication passage 236 that delivers lubricant from mandrel rod 34 to coupler 232 and mandrel balls 38. Lubrication passage 270 includes a main channel 294 defined by body 263 and threaded nipple 261 extending along axis 276 and several side channels 298 extending from main channel 294 to outer surface 65 of retainer 256 as shown in FIG. 11. Main channel 294 is in communication with mandrel rod lubrication passage 110 and side channels 298 to provide a conduit for moving lubrication between mandrel rod lubrication passage 110 and side channels 298. Side channels 298 is in communication with a lubrication groove defined by outer surface 265 of link 265 to provide a conduit for moving lubrication to a lubrication groove 212. Groove 212 is in communication with side channels 298 formed in link 248 and side channels 114 formed in retainer 256 to provide a conduit for moving lubrication from side channels 298 formed in link 248 to side channels 114 formed in retainer 256. Side channels 114 then provide a conduit for moving lubrication from groove 212 to outer surface 282 of connector 256 to provide lubrication between tube 12 and mandrel assembly 220.

Similar to mandrel assembly 20, mandrel assembly 220 is removably coupled to mandrel rod 34 in a predetermined position relative to mandrel rod 34 so that calibration is not required upon exchange of mandrel assemblies 220. Similar to mandrel assembly 20, it is periodically necessary to remove mandrel assembly 220 from mandrel rod 34 to either replace it for wear and tear or for bending a different sized tube. When such a change is required, a mandrel assembly 220 is removed from mandrel rod 34 and replaced with another mandrel assembly 220 at a predetermined position in relation to mandrel rod 34 along axis 276. As previously mentioned, it is necessary to maintain this predetermined position so that mandrel balls 38 are properly positioned relative to die assembly 16. Each mandrel assembly 220 is coupled to mandrel rod 34 in the same predetermined position as mandrel assembly 20. Link 248 is formed to include the same quick change over and calibration features of mandrel assembly 20 as shown in FIG. 5.

Although the invention has been described in detail with reference to certain preferred embodiments, variations and modifications exit within the scope and spirit of the invention as described and defined in the following claims.

What is claimed is:

1. A mandrel assembly for a tube bender, the mandrel assembly comprising a mandrel rod configured to be coupled to a tube bender, a mandrel ball having a body and a projection coupled to the body, and a coupler including a link, a first connector member, a second connector member, and a retainer, the link including a body having a first end and a second end coupled to the mandrel rod and spaced apart from the first end and a collar coupled to the first end of the body, the first and second connector members being positioned to lie over the first end of the body of the link and cooperate to define a groove sized to receive the collar of the link and a socket sized to retain the projection of the mandrel ball, the retainer being positioned to lie over the first and second connector members and the link to secure the first and second connector members to the link.

2. The mandrel assembly of claim 1, wherein the mandrel rod includes a first end including a shoulder and a connection portion having a length and a second end configured to be coupled to the tube bender, the first end of the body of the link includes a shoulder, the link further includes a connection portion coupled to the body of the link that has a length that is less than the length of the connection portion of the mandrel rod so that the shoulder of the mandrel rod abuts the shoulder of the body.

3. The mandrel assembly of claim 1, wherein the mandrel rod includes a lubrication passage, the link includes a lubrication channel in communication with lubrication passage of the mandrel rod, and the retainer includes a lubrication channel in communication with the lubrication channel of the link.

4. The mandrel assembly of claim 1, wherein the projection of the mandrel ball includes a ball, and the socket is configured to receive the ball.

5. The mandrel assembly of claim 1, wherein the first end of the body includes a surface cooperating with the first and second connector members to define the socket.

6. The mandrel assembly of claim 1, wherein the retainer includes an inner surface configured to receive first and second connector members and a flange configured to abut the first and second connector members.

7. The mandrel assembly of claim 5, wherein the surface of the body defines a dimple.

8. The mandrel assembly of claim 7 further including a snap ring, wherein the snap ring is coupled to the link and the flange of the retainer is positioned between the first and second connector members and the snap ring.

9. A coupler configured to couple a mandrel ball to a mandrel rod, the mandrel ball including a body and a projection coupled to the body, the coupler comprising a link configured to be coupled to a mandrel rod, a first connector member coupled to the link, a second connector member coupled to the link, the first and second connector members cooperating to define a socket configured to receive a projection of a mandrel ball, and a retainer moveable relative to the link between a first position securing the first and second connector members to the link and a second position permitting removal of at least one of the first and second connector members from the link.

10. The coupler of claim 9, wherein the first and second connector members are removable from the link when the retainer is in the second position.

11. The coupler of claim 9, further comprising a fastener, wherein the fastener couples the retainer to the link.

12. The coupler of claim 9, wherein the link includes a lubrication channel and the retainer includes a lubrication channel in communication with the lubrication channel of the link.

13. The coupler of claim 9, wherein the retainer is positioned to lie over the link.

14. The coupler of claim 9, wherein the retainer is a sleeve.

15. The coupler of claim 11, wherein the fastener is a snap ring.

16. The coupler of claim 11, wherein the link includes a body and a collar coupled to the body and the retainer includes a flange positioned to lie between the collar and the fastener.

17. The coupler of claim 12, wherein the retainer includes an outer surface and an inner surface and the lubrication channel extends between the outer and inner surfaces.

18. The coupler of claim 17, wherein the sleeve includes a radially extending flange.

19. A coupler configured to couple a mandrel ball to a mandrel rod, the mandrel ball including a body and a projection coupled to the body, the coupler comprising a link configured to be coupled to a mandrel rod, the link including an exterior surface, a connector coupled to the exterior surface of the link, the connector including a socket configured to receive a projection of a mandrel ball, and a retainer configured to engage the connector to restrain movement of the connector relative to the link.

20. The coupler of claim 19, wherein the retainer restrains axial movement of the connector relative to the link.

21. The coupler of claim 19, wherein the retainer restrains radial movement of the connector relative to the link.

22. The coupler of claim 19, further comprising a fastener, wherein the retainer is positioned between the fastener and the link.

23. The coupler of claim 19, wherein the retainer is positioned over the first and second connector members.

24. The coupler of claim 19, wherein the retainer includes a flange that abuts the first and second connector members.

25. The coupler of claim 19, wherein the retainer is a sleeve positioned over the connector.

26. The coupler of claim 25, wherein the sleeve includes a flange that abuts the connector.

27. The coupler of claim 25, wherein the sleeve includes an inner surface and the connector includes an outer surface that abuts the inner surface of the sleeve.

28. A mandrel assembly for a tube bender, the mandrel assembly comprising, a mandrel rod including a lubrication passage, a mandrel ball including a body and a projection coupled to the body, and a coupler including a link coupled to the mandrel rod, the link including a lubrication channel in communication with the lubrication passage of the mandrel rod, a connector coupled to the link and including a socket configured to receive a projection of a mandrel ball, and a retainer including a lubrication channel configured to communicate with the lubrication channel of the link.

29. The coupler of claim 28, wherein the channel of the link includes an axially extending portion in communication with the lubrication passage of the mandrel rod and a radially extending portion in communication with the lubrication channel of the retainer.

30. The coupler of claim 28, wherein the link includes an outer surface defining a groove in communication with the lubrication channel of the link and the lubrication channel of the retainer.

31. The coupler of claim 28, wherein the retainer includes an inner surface and an outer surface and the lubrication channel of the retainer extends between the inner and outer surfaces of the retainer.

32. The coupler of claim 28, wherein the retainer is positioned over the connector.

33. The coupler of claim 28, wherein the retainer is positioned over the link.

34. The coupler of claim 30, wherein the retainer includes another lubrication channel in communication with the groove formed in the link.

35. The coupler of claim 30, wherein the groove is annular.

36. A tube bender configured to bend a tube having an inside surface, the tube-bending apparatus comprising, a tube gripper configured to grip an inner surface of a tube, the tube gripper including an inner surface having a diameter and a mandrel assembly including a mandrel rod configured to move within the tube gripper, a mandrel ball, and a coupler configured to couple the mandrel ball to the mandrel rod, the coupler including an outer surface having a diameter less than the diameter of the inner surface of the tube gripper.

37. The tube bender of claim 36, wherein the coupler is positioned in the tube gripper.

38. The tube bender of claim 36, wherein the coupler includes a link having a first end coupled to the mandrel rod and a second end, a connector configured to couple the mandrel ball to the second end of the link, and a retainer configured to couple the connector to the link.

39. The tube bender of claim 36, wherein mandrel rod includes a connection portion and the coupler includes a connection portion coupled to the connection portion of the mandrel rod and positioned within the tube gripper.

40. The tube bender of claim 38, wherein the link includes an outer surface having diameter less than the diameter of the inside surface of the tube gripper.

41. The tube bender of claim 38, wherein the mandrel rod includes a connection portion having a length, the first end of the link includes a connection portion coupled to the connection portion of the mandrel rod, the connection portion of the link has a length that is less than the length of the connection portion of the mandrel rod.

42. The tube bender of claim 38, wherein the retainer has an outer surface having a diameter and the link has an outer surface having a diameter that is less than the diameter of the outer surface of the retainer.

43. The tube bender of claim 38, wherein the link is positioned within the tube gripper.

44. The tube bender of claim 41, wherein the mandrel rod includes a shoulder and the first end of the link includes a shoulder that abuts the shoulder of the mandrel rod.

* * * * *